US006332417B1

(12) United States Patent
Vornholt

(10) Patent No.: US 6,332,417 B1
(45) Date of Patent: Dec. 25, 2001

(54) SEWING MACHINE NEEDLE HAVING A SLENDER EYE

(75) Inventor: Harry Vornholt, Bitz (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/660,415

(22) Filed: Sep. 12, 2000

Related U.S. Application Data

(63) Continuation of application No. 09/570,387, filed on May 12, 2000.

(30) Foreign Application Priority Data

May 12, 1999 (DE) ..... 199 21 913

(51) Int. Cl.[7] ..... D05B 85/00
(52) U.S. Cl. ..... 112/222
(58) Field of Search ..... 112/222, 224

(56) References Cited

U.S. PATENT DOCUMENTS 3,322,085 * 5/1967 Weiss ..... 112/222
3,469,548 * 9/1969 Zocher ..... 112/222
3,929,082 * 12/1975 Zocher ..... 112/222
3,954,072 * 5/1976 Zocher ..... 112/222

FOREIGN PATENT DOCUMENTS 26 23 796 6/1977 (DE) .
30 27 534 2/1982 (DE) .
36 36 706 5/1988 (DE) .
2 041 021 9/1980 (GB) .
2218390-A * 8/1990 (JP) ..... 112/222

* cited by examiner

*Primary Examiner*—Ismael Izaguirre
(74) *Attorney, Agent, or Firm*—Venable; Gabor J. Kelemen

(57) ABSTRACT

A sewing machine needle includes a central longitudinal axis; a blade extending at least partially coaxially with the axis and terminating in a point; and an eye passing though the blade transversely to the axis and having an opening direction. The eye has opposite openings on opposite sides of the blade. Two mutually spaced walls forming part of the blade have respective inner faces bounding the eye. An indentation is provided in the blade in a region of at least one of the eye openings. The indentation reduces the height of at least one part of the eye walls as measured from the axis.

21 Claims, 3 Drawing Sheets

SEWING MACHINE NEEDLE HAVING A SLENDER EYE

CROSS REFERENCE TO RELATED APPLICATION

This application is a continuation of co-pending application Ser. No. 09/570,387 filed May 12, 2000.

This application claims the priority of German Application No. 199 21 913.3 filed May 12, 1999, which is incorporated herein by reference.

BACKGROUND OF THE INVENTION

This invention relates to a sewing machine needle, particularly for rapidly operating sewing machines which have high stitch output.

As a rule, the output of current industrial sewing machines is 5,000 stitches per minute; in some applications even 8,000 or more stitches per minute are reached.

During the sewing operation the sewing machine needle penetrates the workpiece (hereafter referred to as fabric) to produce a stitch hole. The time available for opening the stitch hole is the period from the moment the needle point touches the fabric to the moment when the needle eye passes the stitch hole. Such an opening period is approximately 0.5 ms for a stitching machine which operates with 5000 stitches per minute. The opening of the stitching hole occurs as a rapid, almost explosion-like lateral displacement of the fabric During such an occurrence, high frictional forces are generated and thus high penetrating forces as well as high operating power for the sewing operation are required.

Sewing with a very high number of stitches per minute involves the risk of mechanical and thermal damage to the fabric. Fibers or even fiber bundles (yarns) may be torn apart as stitch holes are being formed. Further, the high friction forces may heat the needle to temperatures which, within a few seconds, may cause the usual synthetic fibers to reach their melting point. Such fibers then are melted or fused in the stitching zone. A further consequence may be frequent ruptures of the sewing thread.

The fusing of laminates and layers as well as color or other components may lead to further disturbances during the sewing operation. The discussed problems may lead to a deteriorated seam quality and may adversely affect the strength of the manufactured apparel.

Further, needles for sewing machines, particularly those which operate at high machine speeds, are exposed to relatively large mechanical stresses. Increasing machine speeds cause dynamic problems to an increased extent. The masses rotating in the sewing machine may cause vibrations which affect particularly the sewing machine needles clamped at one end. The sewing machine needles furthermore have to withstand external forces such as the pull of the thread, lateral excursions upon contacting the fabric as well as forces derived from handling the sewing machine by the operating personnel. If, for achieving an increased stability, thicker needles are used, the above-outlined problems become even more pronounced.

During sewing the thread must be protected from being damaged as it is pushed through the fabric by the needle. Therefore, in industrial sewing machines it is a desideratum that the needle, even in case of extremely high reciprocating speeds, ensures a substantially frictionless run of the thread during the entire stitch forming cycle. Since the thread thickness is in most cases predetermined for providing the desired seam strength, the sewing machine needle must guide the thread of predetermined thickness with low friction and must adequately protect the thread even in the high-speed range. Also, an excessive motion caused friction between the thread and the fabric is to be avoided in the high-speed range. In case such a requirement cannot be ensured, uncontrollable thread ruptures and misses in the stitching operation result.

German Offenlegungsschrift (application published without examination) 30 27 534 discloses a sewing machine needle having a laterally bent blade. A thread trough provided along the needle blade leads to a needle eye which is positioned in the vicinity of the needle point. The thread trough is defined by two lateral walls which extend into the eye region. The needle contour is substantially linear in the region of transition from the laterally bent zone to the needle point. The above-described difficulties during high-speed sewing operations may involve sewing machine needles of the above-outlined conventional type.

SUMMARY OF THE INVENTION

It is an object of the invention to provide an improved sewing machine needle which is adapted for high-speed operation.

This object and others to become apparent as the specification progresses, are accomplished by the invention, according to which, briefly stated, the sewing machine needle includes a central longitudinal axis; a blade extending at least partially coaxially with the axis and terminating in a point; and an eye passing through the blade transversely to the axis and having an opening direction. The eye has opposite openings on opposite sides of the blade. Two mutually spaced walls forming part of the blade have respective inner faces bounding the eye. An indentation is provided in the blade in a region of at least one of the eye openings. The indentation reduces the height of at least one part of the eye walls as measured from the axis.

The sewing machine needle according to the invention has a reduced volume of the eye cross section while the eye width remains the same and, at the same time, exhibits improved thread protecting characteristics. As a result, the stitch hole for the thread of a given thickness needs to be opened less wide than required conventionally, whereby friction effects on the sewing machine needle and the fabric are reduced. The reduction of the eye cross section is achieved by the indentation formed on the trough-side of the needle blade. Such an arrangement does not adversely affect the eye width and thus threads of usual or predetermined thicknesses may be used.

The indentation changes the deployment characteristic of the piercing force. The first force peak which dominantly occurs during the passage of the eye of a normal needle is in most cases significantly reduced. The maximum stitch hole widening occurs relatively gently only as the upper needle blade penetrates, that is, when the lowering motion of the needle becomes slower and approaches zero. The explosive effect which in case of a conventional needle occurs by virtue of the maximum stitch hole widening at the highest penetration velocity is minimized or prevented altogether.

According to the invention, advantageously a lesser piercing force is present, and thus a lesser energy input is required for the stitching process, accompanied, at the same time, by a lesser needle heat-up and a stitch hole opening process which treats the material gently. Further, the eye may be configured such that a high degree of thread protection is obtained, resulting in fewer stitch misses and thread breakage.

The indentation is preferably dimensioned in such a manner that at least at one location the eye walls have a total height which is slightly less than the height of a region which is situated between the needle point and the eye. As a result, it is feasible to equalize to some extent the width increase of the needle from the needle point to the needle eye by a simultaneously slight flattening to thus achieve an overall, only small cross-sectional increase of the needle. This feature reinforces the above-discussed advantages.

In accordance with an advantageous feature of the invention, the sewing machine needle has at least in one certain region of the eye a substantially constant overall height; this contributes to the delay of the stitch hole opening process during needle penetration.

The indentation of the sewing machine needle has, according to another advantageous feature of the invention, a substantially constant radius; the center of the curvature may be situated approximately at the height of the eye (that is, in a linear extension of the eye). The radius of curvature is preferably relatively large and is, according to an advantageous example, approximately three to four times the nominal needle thickness to be measured in a blade region of unreduced thickness.

While the sewing machine needle according to the invention has an indentation at the needle eye on the side where the thread trough extends, the eye walls at the opposite side of the eye are preferably of straight configuration, whereby in this location too, no projection or almost no projection beyond the eye is present.

The thickness of one and the same eye wall may vary from one side of the eye to the other. For example, it is advantageous if the eye walls have a slightly greater thickness at their side adjoining the indentation than at their side remote therefrom. In such a configuration the side walls of the needle may extend parallel to the central axis and may be arranged at an acute angle to one another in the transverse direction.

In accordance with a particularly advantageous feature of the invention, the sewing machine needle has a thread trough which extends into the eye region with an undiminished height. The height of the walls defining the thread trough are constant along the entire thread trough particularly up to the eye and the indentation formed in the eye region. This ensures a maximum thread protection while, at the same time, the eye is of very slim configuration and thus the widening process of the stitch hole is slow and the required piercing forces are small.

The blade of the sewing machine needle is advantageously provided with a laterally offset portion which defines a hollow part on that side of the needle which is remote from the thread trough. The hollow part provides a space for a thread gripper which engages the thread during seam formation.

According to an advantageous feature of the invention, the height of the thread trough walls is, in the region of transition into the eye, slightly increased which further enhances the protection of the thread.

As viewed in the direction of the central needle axis, the eye is advantageously bounded by rounded eye webs which are offset relative to the central axis. The rounding of the eye webs is so dimensioned that the ends of the eye webs are semicircular, and the axes of the rounding of the webs are offset with respect to one another by approximately one-half of the eye height. The arrangement is preferably such that a tangent passing through the eye forms, with the central needle axis, an angle which is preferably significantly smaller than 20°. A thread which runs taut through the eye and has a thread thickness which corresponds to the thickness of the sewing yarn, forms with the central axis an angle which is preferably also smaller than 20°.

DESCRIPTION OF THE PREFERRED EMBODIMENT

Figures 1, 2, 3, 4, 5:
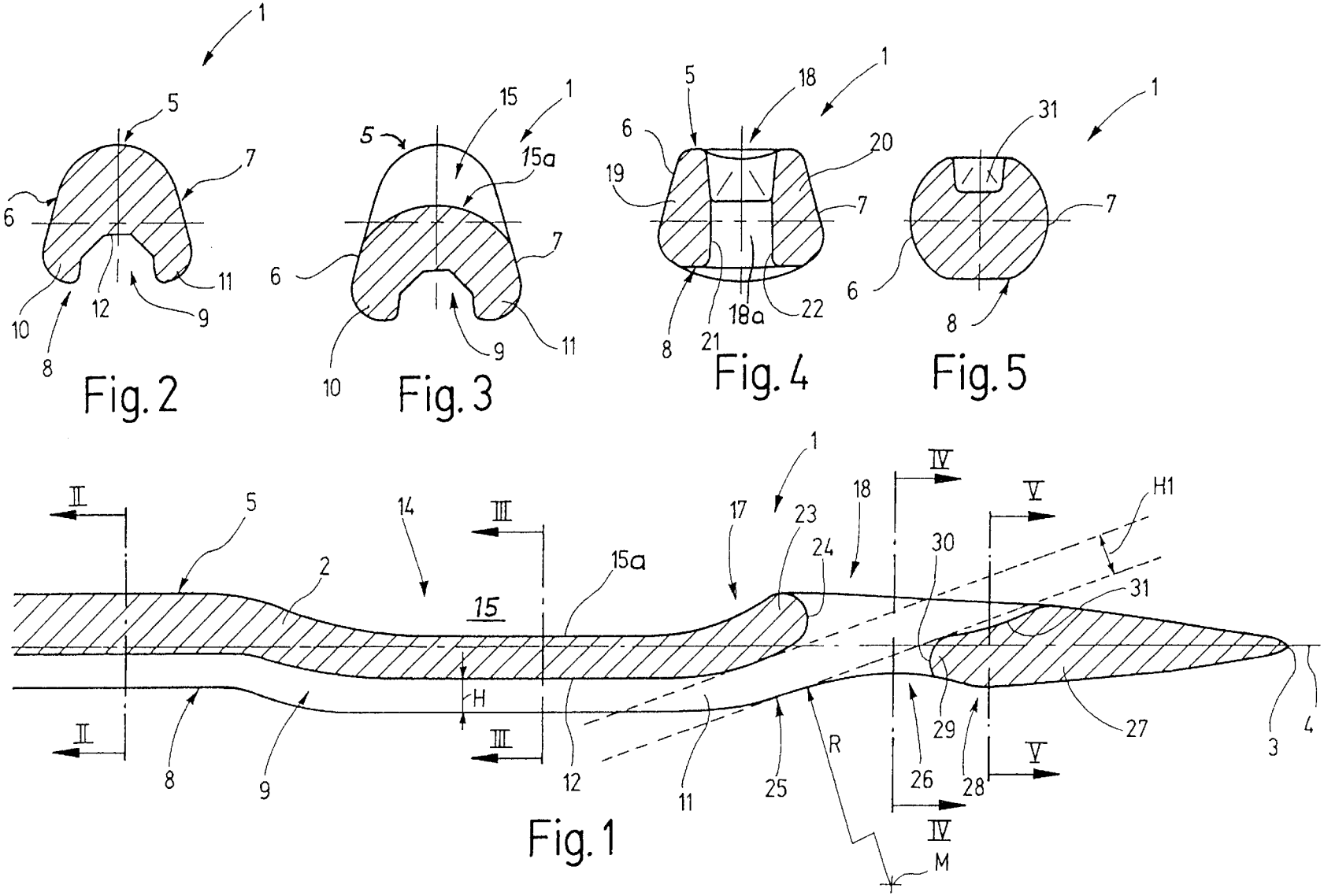
FIG. 1 is a longitudinal sectional elevational view of a terminal portion of a sewing machine needle structured according to the invention.
FIG. 2 is a sectional view taken along line II—II of FIG. 1.
FIG. 3 is a sectional view taken along line III—III of FIG. 1.
FIG. 4 is a sectional view taken along line IV—IV of FIG. 1.
FIG. 5 is a sectional view taken along line V—V of FIG. 1.

FIG. 1 shows an end portion of a sewing machine needle 1 having a blade 2 which terminates in a needle point 3. The blade 2 has a central longitudinal axis 4 which passes through the point 3. The blade 2 extends from a non-illustrated needle shank at which the needle is clamped in a socket of the sewing machine (also not shown).

As seen from FIG. 2, in the left-hand portion of the FIG. 1 illustration, the needle blade 2 has, as viewed cross-sectionally, a rounded upper surface 5 and planar lateral faces 6 and 7. At its underside 8 the needle 1 is provided with a thread trough 9 which is bounded by two side walls 10 and 11 which are connected by a trough bottom 12. The transition between the walls 10 and 11, on the one hand, and the trough bottom 12, on the other hand, may be polygonal or rounded.

As shown in FIG. 1, the thread trough 9 extends along the blade 2 and an offset region 14 thereof in which the needle is laterally outwardly bent relative to the blade axis 4. The offset region 14 defines a depressed needle portion 15 at the top side 5 of the needle 1. The bottom surface 15*a* of the depressed portion 15 is at a small distance from the central axis 4. The cross-sectional configuration of the needle 1 in this region is illustrated in FIG. 3. As seen, in the offset region 14 the needle 1 is widened but is of a slightly flatter configuration as compared to the region illustrated in FIG. 2. The cross sections of the blade 2 shown in FIGS. 2 and 3 are approximately of the same area; they are about 12% smaller than the nominal cross-sectional area.

The offset region 14 is adjoined by a transitional region 17 in which the center of the cross section is shifted back from an offset position onto the central axis 4 or the vicinity thereof. The thread trough 9 extends through the offset region 14 and the transitional region 17 to a needle eye 18 which, as shown in FIG. 1, is situated adjacent the needle point 3. The eye 18 extends through the needle 1 in a direction which is the same as the direction of offset in the offset region 14. As seen from the cross section illustrated in FIG. 4, the eye 18 is bounded by two eye walls 19 and 20 between which a passage 18*a* is formed The eye walls 19 and 20 are at their facing inner surfaces 21, 22 essentially of planar or slightly curved configuration and extend approximately parallel to one another, whereas the outer faces 6 and 7 of the respective eye walls 19 and 20 are oriented at an acute angle to one another. As a result of this arrangement, the eye walls 19, 20 have at the sides of the thread trough 9 a slightly greater wall thickness than on the side remote from the thread trough 9. In this zone the total needle cross section is up to 10% less than the nominal needle thickness.

In the transitional region 17 an eye web 23 is formed whose end 24 borders the eye 18 in the axial direction (that is, in the direction of the central axis 4). The end 24 is rounded with the greatest possible radius and lacks any edges. The bottom 12 of the thread trough 9 thus extends without any edge up to the end 24 of the eye web 23. The side walls 10, 11 of the thread trough 9 change from a first height H measured in the offset region 14 to a slightly enlarged height H1 in a parallel region 25 in which the thread trough 9 extends obliquely to the central axis 4. At the end of the parallel region 25 the lateral walls 10, 11 of the thread trough 9 merge into the eye walls 19, 20. At that location, that is, in the region of the eye 18, the eye walls 19, 20, as shown in FIG. 1, are provided with an indentation 26 by means of which the eye inlet adjoining the trough 9 is offset towards the central axis 4. The eye 18 is, along the needle axis 4, adjoined by a conical needle region 27 which tapers toward and terminates in the needle point 3. The largest radius of the conical region 27, measured at the needle portion designated at 28, is greater than the distance of the inlet of the eye 18 in the region of the indentation 26 from the central axis 4. By virtue of this arrangement the inlet of the eye 18 is offset against the conical region 27. The indentation 26 has, as shown in FIG. 1, a curvature, whose radius R has a starting point M which is, situated on the side of the thread trough 9 in the extension of the passage defined by the eye 18. The radius R is approximately four times greater than the nominal needle thickness.

The indentation 26 is directly adjoined by a second eye web 29 which is rounded at its end 30 oriented towards the eye 18. The eye web 29 merges into a concave bottom surface 31 on the side remote from the indentation 26. The approximately circular cross-sectional configuration of this region is shown in FIG. 5. At the transition of the eye 18 into the conical region 27 the cross section of the needle is slightly flattened. In this region the cross section is approximately 20% less than the cross section which corresponds to the nominal needle thickness.

The eye webs 23 and 29 are offset relative to one another transversely to the axis 4 at a distance which is at least 40% (preferably 50%) of a nominal needle thickness measured in a blade zone of unreduced blade thickness. Further, the eye webs 23 and 29 have a thickness, measured transversely to the axis 4, which is at least 40% (preferably 50%) of the nominal needle thickness.

In the description which follows the operation of the above-described sewing machine needle will be set forth.

Figure 6:
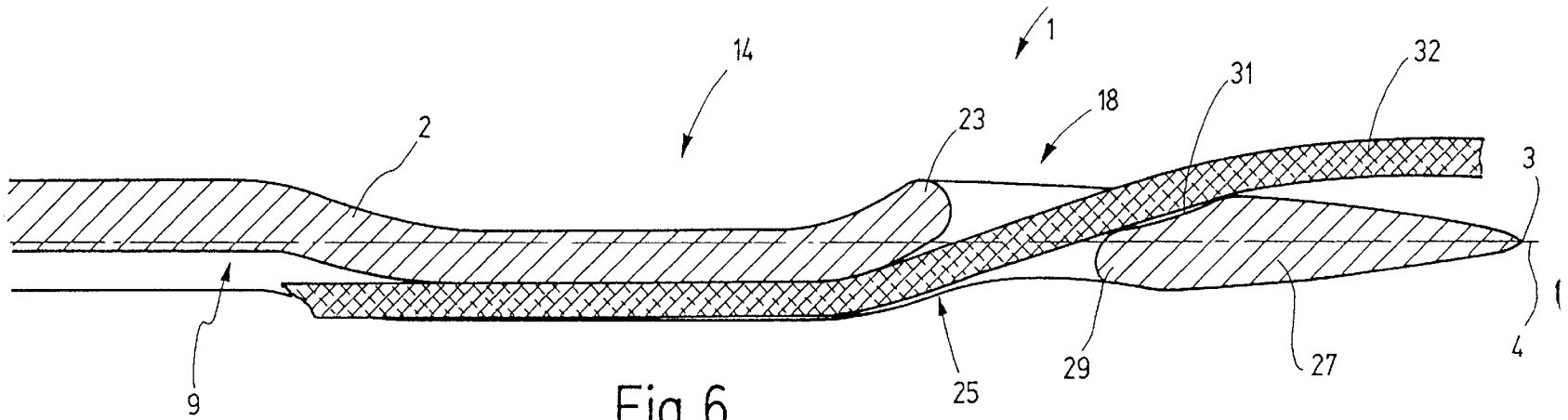
FIG. 6 is a view similar to FIG. 1, illustrating a thread passing through the needle eye and depicting the arrangement before the penetrating step.

FIG. 6 shows the sewing machine needle 1 and a sewing yarn 32 which is positioned in the thread trough 9. Then, in the end region of the trough 9 the yarn 32 changes direction and passes in a linear, taut condition through the eye 18 and thereafter bridges the concave bottom surface 31. In this position of the sewing yarn 32 the needle 1 has not yet penetrated into the fabric.

Figure 7:
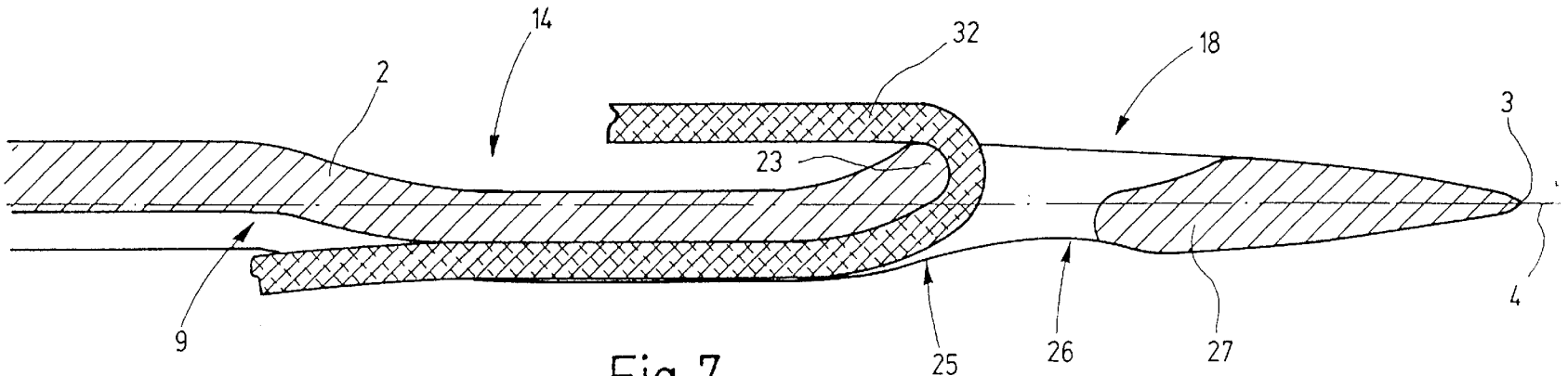
FIG. 7 is a view similar to FIG. 1, illustrating a thread passing through the needle eye and depicting the arrangement during the penetrating step.

The needle starts its approach towards the fabric and begins penetration thereof. First, the point 3 enters the fabric and thereafter, as the needle continues its axial motion, the conical region 27 enters the fabric and the stitch hole is widened until the eye 18 reaches the fabric. Such a widening occurs gradually and relatively uniformly so that the sewing yarn 32 may be pulled through the stitch hole and, while doing so, positions itself about the eye web 23 as shown in FIG. 7. The fabric, during the piercing process, slides over the eye 18 and simultaneously the fabric is, by virtue of the height of the thread trough 9, maintained at a distance by the parallel region 25 from the sewing yarn 32 situated in the thread trough 9. Thus, the sewing yarn 32 may be pulled with high speed into the stitch hole without a substantial friction between the sewing yarn 32 and the fabric. Particularly in the eye region the sewing yarn 32 is effectively protected despite the slender configuration of the eye 18. Such a result is made possible by a combination of the indentation 26 with a heightened (deepened) thread trough in the adjoining parallel region 25.

Figure 8:
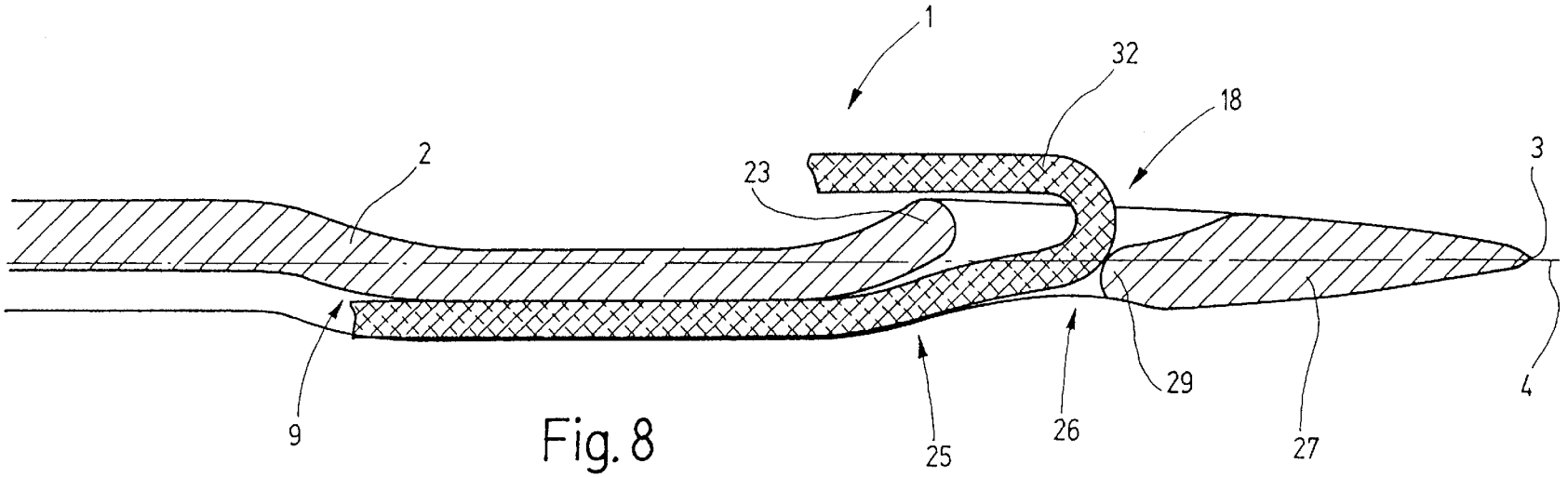
FIG. 8 is a view similar to FIG. 1, illustrating a thread passing through the needle eye and depicting the arrangement shortly after reversing the direction of needle motion, during withdrawal of the needle.
Figure 9:
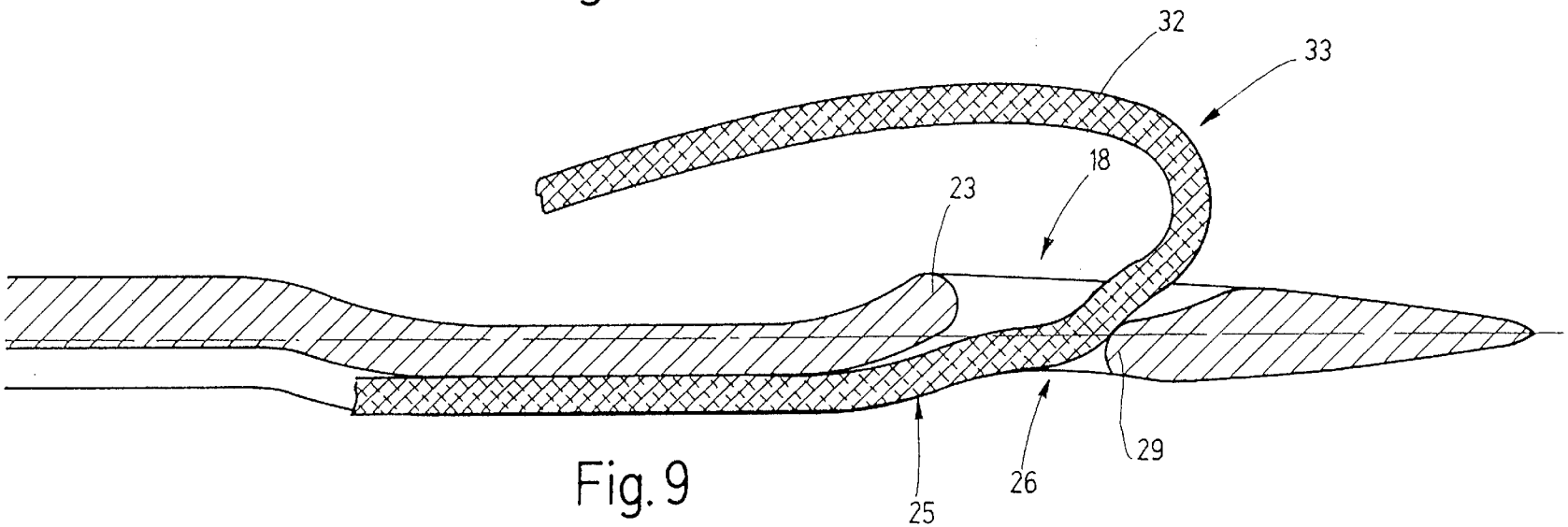
FIG. 9 is a view similar to FIG. 1, illustrating a thread passing through the needle eye and depicting the arrangement during the reverse stroke of the needle and showing an ideally formed thread loop for being received by a loop gripper.

Upon termination of the piercing step, the sewing machine needle 1 is withdrawn whereby the sewing yarn 32 first assumes its position illustrated in FIG. 8. As seen, the sewing yarn lifts off the eye web 23 and subsequently forms a loop 33 as shown in FIG. 9. The eye web 29, by virtue of its lateral offset relative to the eye web 23, prevents the sewing yarn 32 from exiting in the direction of the thread groove 9. Rather, the sewing yarn 32 is pressed out of the eye 18 by the eye web 29 so that the desired loop 33 is reliably formed. Subsequently, as the sewing process progresses, the loop is received by a non-illustrated gripper. An accurately formed loop makes possible a disturbance-free sewing operation.

Thus, according to the invention, a sewing machine needle is provided particularly for high operating speeds, having a slender eye 18 which merges directly in a thread trough 9 running along the needle blade. At the side of the thread trough 9 the eye 18 is provided with an indentation 26 which results in a small eye cross section and thus the fabric will be exposed only to a small stress during the piercing process. In the transitional region from the thread trough 9 to the eye 18 the wall portions bounding that region are of such a height (as measured from the bottom 12 of the thread trough 9) that the sewing yarn 32 remains unexposed and is thus effectively held at a distance from the fabric.

It will be understood that the above description of the present invention is susceptible to various modifications, changes and adaptations, and the same are intended to be comprehended within the meaning and range of equivalents of the appended claims.

What is claimed is:

1. A sewing machine needle for high-speed operation, comprising (a) a central longitudinal axis;

(b) a blade extending at least partially coaxially with said axis and terminating in a point;

(c) a sole eye passing through said blade transversely to the axis and having an opening direction; said eye having opposite openings on opposite sides of said blade; each opening having opposite first and second sides spaced from one another in a direction parallel to said axis; said blade having a height measured perpendicularly to said axis; said height increasing from said point to a first blade location situated externally of said eye at least at one of said openings and adjoining said first side of said one opening; said height further increasing from said first blade location to a second blade location situated externally of said eye at said one opening and adjoining said second side of said one opening;

(d) two mutually spaced walls forming part of said blade and having respective inner faces bounding said eye; and (e) an indentation provided in said blade in a region of said at least one of said openings; said indentation dropping below a height level of said first and second blade locations; said indentation reducing a height of at least one part of said walls as measured from said axis.

2. The sewing machine needle as defined in claim 1, wherein said walls have, at least at one location, a total height which is less than a height of a region of said blade at a location adjoining said eye and being situated between said point and said eye.

3. The sewing machine needle as defined in claim 1, wherein said walls have a substantially constant total height at least along a portion of said indentation and further wherein a total height of said walls increases in a region adjoining said portion.

4. The sewing machine needle as defined in claim 1, wherein said blade has a length portion offset laterally with respect to said axis; the offset length portion having one side constituting a depression in said blade.

5. The sewing machine needle as defined in claim 1, wherein a length of said eye measured parallel to said axis is less than twice a needle thickness measured transversely to said axis in a blade zone of unreduced blade thickness.

6. The sewing machine needle as defined in claim 1, wherein a length of said eye measured parallel to said axis is less than one and a half a needle thickness measured transversely to said axis in a blade zone of unreduced blade thickness.

7. The sewing machine needle as defined in claim 1, wherein a height of said needle measured at said eye transversely to said axis and parallel to said opening direction is smaller than a nominal needle thickness.

8. The sewing machine needle as defined in claim 1, further comprising a thread trough extending in said blade and merging into said eye in a region of transition; said trough having a bottom; further wherein said walls have a boundary oriented parallel to said bottom.

9. The sewing machine needle as defined in claim 8, wherein said boundary is straight.

10. The sewing machine needle as defined in claim 1, wherein said indentation has a substantially constant radius of curvature.

11. The sewing machine needle as defined in claim 10, wherein said radius of curvature has a starting point situated in a central alignment with said eye as viewed in said opening direction.

12. The sewing machine needle as defined in claim 1, wherein said eye is bordered by rounded eye webs spaced from one another parallel to said axis.

13. The sewing machine needle as defined in claim 12, wherein said eye webs have flanks generally oriented toward one another and further wherein an imaginary line lying on said flanks forms an acute angle of less than 20° with said axis.

14. A sewing machine needle comprising (a) a central longitudinal axis;

(b) a blade extending at least partially coaxially with said axis and terminating in a point;

(c) an eye passing through said blade transversely to the axis and having an opening direction; said eye having opposite openings on opposite sides of said blade;

(d) two mutually spaced walls forming part of said blade and having respective inner faces bounding said eye; and (e) an indentation provided in said blade in a region of at least one of said openings; said indentation reducing a height of at least one part of said walls as measured from said axis; said indentation being provided solely in the region of one of said openings; said walls having a thickness that is greater in a wall zone adjoining said indentation than in a wall zone remote from said indentation.

15. A sewing machine needle having a nominal thickness and comprising (a) a central longitudinal axis;

(b) a blade extending at least partially coaxially with said axis and terminating in a point;

(c) an eye passing through said blade transversely to the axis and having an opening direction; said eye having opposite openings on opposite sides of said blade;

(d) two mutually spaced walls forming part of said blade and having respective inner faces bounding said eye; and (e) an indentation provided in said blade in a region of at least one of said openings; said indentation reducing a height of at least one part of said walls as measured from said axis; said indentation having a substantially constant radius of curvature; said radius being 3–4 times greater than the nominal thickness.

16. A sewing machine needle comprising (a) a central longitudinal axis;

(b) a blade extending at least partially coaxially with said axis and terminating in a point;

(c) an eye passing through said blade transversely to the axis and having an opening direction; said eye having opposite openings on opposite sides of said blade;

(d) rounded eye webs bordering said eye and being spaced from one another parallel to said axis; one of said eye webs having a concave bottom face over which a thread is adapted to run as the thread passes through the eye;

(e) two mutually spaced walls forming part of said blade and having respective inner faces bounding said eye; and (f) an indentation provided in said blade in a region of at least one of said openings; said indentation reducing a height of at least one part of said walls as measured from said axis.

17. A sewing machine needle comprising (a) a central longitudinal axis;

(b) a blade extending at least partially coaxially with said axis and terminating in a point;

(c) an eye passing through said blade transversely to the axis and having an opening direction; said eye having opposite openings on opposite sides of said blade;

(d) rounded eye webs bordering said eye and being spaced from one another parallel to said axis; said rounded eye webs having a thickness and a radius of curvature having a length equaling approximately one half of the web thickness;

(e) two mutually spaced walls forming part of said blade and having respective inner faces bounding said eye; and (f) an indentation provided in said blade in a region of at least one of said openings; said indentation reducing a height of at least one part of said walls as measured from said axis.

18. The sewing machine needle as defined in claim 17, wherein said eye webs are offset relative to one another transversely to said axis at a distance which is 50% of a nominal needle thickness measured in a blade zone of unreduced blade thickness; and further wherein said eye webs have a thickness, measured transversely to said axis, which is 50% of the nominal needle thickness.

19. The sewing machine needle as defined in claim 17, wherein said eye webs are offset relative to one another transversely to said axis at a distance which is at least 40% of a nominal needle thickness measured in a blade zone of unreduced blade thickness; and further wherein said eye webs have a thickness, measured transversely to said axis, which is at least 40% of the nominal needle thickness.

20. The sewing machine needle as defined in claim 17, wherein said eye webs are offset relative to one another transversely to said axis at a distance which is 50% of a nominal needle thickness measured in a blade zone of unreduced blade thickness; and further wherein said eye webs have a thickness, measured transversely to said axis, which is at least 40% of the nominal needle thickness.

21. The sewing machine needle as defined in claim 17, wherein said eye webs are offset relative to one another transversely to said axis at a distance which is at 40% of a nominal needle thickness measured in a blade zone of unreduced blade thickness; and further wherein said eye webs have a thickness, measured transversely to said axis, which is 50% of the nominal needle thickness.

* * * * *